United States Patent [19]

Chubb

[11] Patent Number: 5,060,442

[45] **Date of Patent: * Oct. 29, 1991**

[54] LOUVERED PLASTIC BUILDING PRODUCT

[75] Inventor: Norman L. Chubb, Dearborn, Mich.

[73] Assignee: Tapco Products Company, Inc., Detroit, Mich.

[ * ] Notice: The portion of the term of this patent subsequent to Aug. 23, 2005 has been disclaimed.

[21] Appl. No.: 598,351

[22] Filed: Oct. 16, 1990

[51] Int. Cl.[5] ..... E06B 7/08

[52] U.S. Cl. ..... 52/473; 52/822; 52/823

[58] Field of Search ..... 52/473, 822, 823, 458

[56] References Cited

U.S. PATENT DOCUMENTS 4,251,966 2/1981 Foltman ..... 52/309.1

4,765,110 8/1988 MacLeod ..... 52/473

*Primary Examiner*—Richard E. Chilcot, Jr.

*Assistant Examiner*—Wynn Wood

*Attorney, Agent, or Firm*—Barnes, Kisselle, Raisch, Choate, Whittemore & Hulbert

[57] ABSTRACT

A louvered plastic building product comprising a pair of plastic side rails which may be cut to desired length, a plurality of plastic shutter panels slidably received within tracks extending along the side rails, upper and lower plastic end rails extending between the side rails and capturing the panels in assembly, and a mullion piece separating the panels. The length of the side rails may be greater than the assembled length of the upper and lower end rails, panels and mullion. The mullion piece is providing with a lip that overlaps a portion of the adjacent panel such that when the various parts are assembled, the panels and mullion piece can be moved vertically to accommodate dimensional variations in length between the side rails and the assembled parts.

5 Claims, 4 Drawing Sheets

LOUVERED PLASTIC BUILDING PRODUCT

BACKGROUND AND SUMMARY OF THE INVENTION

Adjustable length louver and panel shutters, including specifically shutters of modular rigid molded plastic construction, have heretofore been proposed in the art. The Foltman U.S. Pat. No. 4,251,966 discloses such a shutter as comprising a pair of extruded side rails having respective single-channel tracks disposed in opposition. Louvered panels are injection molded with integral side runners which are slidably received in the opposing tracks. Upper and lower cross pieces are fastened to the side rails by fasteners to hold the panels in place. The modular pieces are precoated to filter ultraviolet radiation and thereby prevent fading and deterioration.

The Frederick U.S. Pat. No. 3,455,079 shows an adjustable length shutter comprising a one-piece louver panel with integral side rails and separate end cross pieces or rails. See also the U.S. Pat. Nos. 3,191,242 to Rauen 3,797,186 to Smith and 3,968,738 to Matzke.

One problem with many adjustable length shutter assemblies of the prior art is requirement for complex cutting or trimming operations for tailoring overall length at the installation site. The side rails in Foltman, for example, are cut to length in a stepped, rather than a planar, configuration. In Frederick, the integral panel and side rails must be trimmed to length and then slotted to receive the end rails. Another problem is that although the panels and rails are initially coated at the factory to screen ultraviolet solar radiation, edges which are cut in the field may be exposed to radiation, resulting in unsightly fading and possible structural deterioration.

In U.S. Pat. No. 4,765,110, there is provided an adjustable length shutter assembly of molded plastic modular construction comprising a pair of side rails which may be cut to desired length, one or more shutter panels slidably received within parallel double-channel tracks extending along the opposite side rails, and upper and lower ends rails extending between the side rails and capturing the shutter panels in assembly. In a preferred embodiment of the invention, at least two shutter panels are carried between the shutter side rails and are separated from each other by a mullion piece. In accordance with one important feature of the present invention, the end rails and the mullion piece are so constructed as to overlap the edges of the side rails and shutter panels which are adapted to be adjustable trimmed during the installation process so as to reduce fading and structural deterioration at the cut edges due to exposure to ultraviolet solar radiation. Another feature of the invention contemplates an improved structural connection between the end rails and side rails which not only overlaps the cut edges of the end rails as previously described, but also enhances structural rigidity of the overall shutter assembly during and following installation.

It has been found where such an adjustable shutter assembly is made in long lengths, the shutter panels expand to a different degree than the side rails and, as a result, there may be a gap between the end rails, shutter panels and mullion.

Another problem that occurs with respect to such plastic louvered building products is that the length of the assembled product is limited to increments corresponding to the width of each louver. Each louver panel can only be cut between louvers. As a result, the length of the assembly can not be to a lesser overall length.

Accordingly among the objectives of the present invention are to provide a plastic louvered building product such as a shutter of modular construction wherein variations due to shrinkage of the parts longitudinally is accommodated readily by the person assembling the parts; wherein the overall length an be in increments less than the width of a louver; wherein the accommodation is achieved at minimal cost; and wherein the resultant product is aesthetically pleasing.

In accordance with the invention, a louvered plastic building product comprises a pair of plastic side rails which may be cut to desired length, a plurality of plastic shutter panels slidably received within tracks extending along the side rails, upper and lower plastic end rails extending between the side rails and capturing the panels in assembly, and a mullion piece separating the panels. The length of the side rails may be greater than the assembled length of the upper and lower end rails, panels and mullion. The mullion piece is providing with a lip that overlaps a portion of the adjacent panel such that when the various parts are assembled, the panels and mullion piece can be moved vertically to accommodate dimensional variations between the side rails and the assembled parts. The construction also permits the overall length of the assembled product to be in increments less than the width of the louvers.

DESCRIPTION

Figure 1:
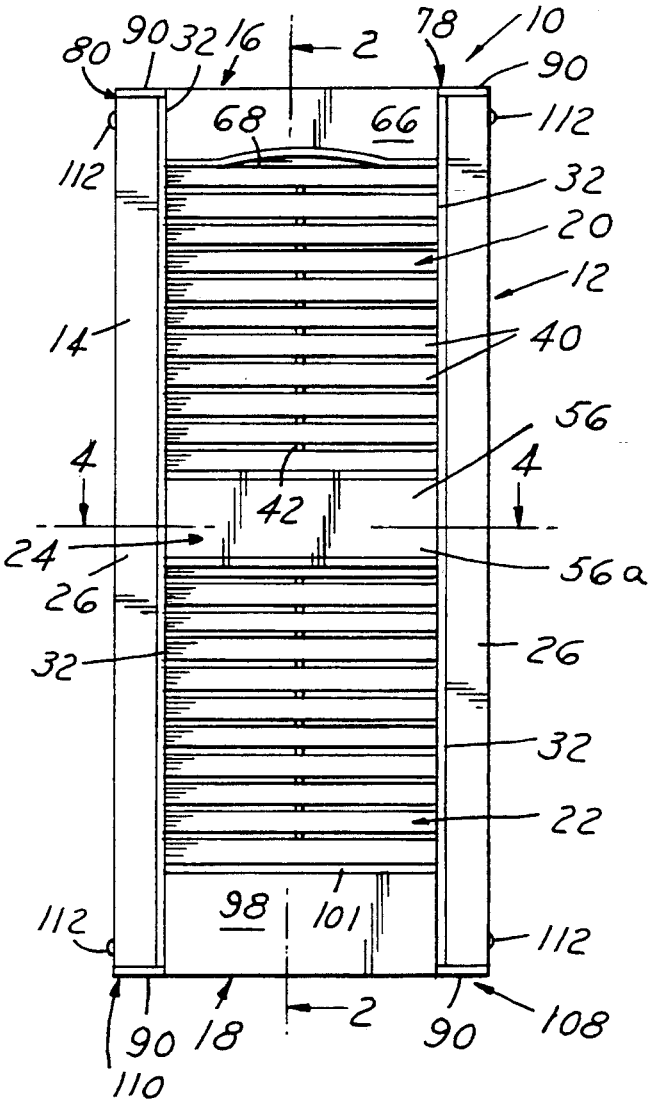
FIG. 1 is an elevational view of a louvered plastic building product embodying the invention.

Referring to FIGS. 1-5, a presently preferred embodiment 10 of the shutter assembly in accordance with the present invention as comprising a pair of laterally spaced side rails 12, 14 upper and lower end rails 16, 18, and a pair of shutter panels 20, 22 carried between side rails 12, 14 and separated from each other by a mullion piece 24. Side rail 14 comprises a front wall 26 and a pair of laterally space generally parallel flanges 28, 30 projecting integrally rearwardly from side edges of front wall 26 to form an open generally C-shaped side rail cross section. A pair of channels are formed by inwardly and oppositely turned flanges 32, 34 extending along the front and rear edges of inside rail wall 30 to provide a flat track entirely along the side rail. Side rail 12 is a mirror image of rail 14 described in detail hereinabove.

Shutter panel 20 comprises a shutter body consisting of a plurality of parallel angulated slots 40 interconnected by a central strengthening rib 42. A pair of flat parallel runners 44, 46 are integrally joined to opposite ends of the several slats 40 and project forwardly and rearwardly of the slat edges so as to be adapted to be slidably received into the longitudinal tracks formed by channels 32, 34 extending lengthwise along the opposing inside walls of side rails 12, 14.

Likewise, shutter panel 22 comprises a central louvered shutter body and a pair of flat parallel runners 52, 54 integrally extending along opposite side edges of wall 48. Runners 52, 54 project forwardly and rearwardly of wall 48 so as to be adapted to be slidably received within the tracks formed by channels 32, 34 in side rails 12, 14.

Mullions 24 comprises a flat front wall 56 having a pair of rearwardly projecting flanges 58, 60 extending along the upper and lower edges of front wall 56. As can best be seen in FIG. 2, flanges 58, 60 function to separate shutter panels 20, 22 from each other in assembly. Front wall 56 projects upwardly and downwardly of flanges 58, 60 in the form of lips 62, 64, extending entirely across mullion 24. A pair of flat parallel runners 66, 68 extend along the laterally spaced side edges of mullion 24 and project forwardly and rearwardly of mullion 24 and project forwardly and rearwardly of mullion front wall 56 so as to be adapted to be slidable received in the tracks formed by side wall channels 32, 34. The lateral ends of support flanges 58, 60 are notched so as not to interfere with rear channels 34.

Upper end rail 16 comprises a front wall 66 having a flat upper edge and a lower edge in the form of a single slat 68 coupled to a wall edge 70 of so-called cathedral contour. A flange 72 projects integrally rearwardly from the upper edge of front wall 66. A pair of flat parallel runners 74, 76 integrally extend along the side edges of front wall 66 and project forwardly and rearwardly therefrom so as to be adapted to be slidably received within the tracks formed by side rail channels 32, 34. A pair of hollow wings 78, 80 integrally project from side rails 74, 76 adjacent flange 72 for affixing upper rail 16 to side rails 12, 14. Wing 80 comprises a generally hollow structure having a front wall 82, an outer side wall 84 and a lower wall 86 sloping away from the upper edge of end rail 16 from adjacent runner 76 to the juncture with side wall 84. The upper surface or wall 88 of wing 80 is contiguously integral with end rail flange 72, and projects forwardly of wing front wall 82 and laterally outwardly of wing side wall 84 in the form of lips 90, 92.

Wings front wall 82 is spaced form side rail 76 by a slot 94 which extends up to top wall 88 for receiving channel 32 of side rail 14 when rail 16 is mounted thereto with wing 80 received internally of the side rail. Slot 94 is formed in wing front wall 82 which is otherwise coplanar with the forward edge of runner 76. The forward edge of runner 76 extends up to lip 90. Wing 78 is the mirror image of wing 80 described in detail above.

Lower end rail 18 comprises a front wall 98 from the upper and lower edges of which a pair of flanges 100, 102 integrally and rearwardly project. Flange 100 forms a support for shutter panel 22. Flange 102 forms a lower end rail wall. Front wall 98 projects beyond flange 100 as a lip 101. A pair of flat parallel runners 104, 106 extend integrally along the lateral side edges of lower rail front wall 98 and project forwardly and rearwardly therefrom so as to be adapted to be slidably received within the side rail tracks formed by channels 32, 34. A pair of wings 108, 110 project laterally outwardly of lower end rail runners 104, 106 and are adapted to be received internally of the lower ends of side rails 12, 14. Wing 108 is identical to wing 80 previously described in detail. Wing 110 is identical to wing 78, and is thus a mirror image of wing 80. Plastic fasteners 112 are received in aligned openings in the side rail outer walls 28 and the wing outer walls 84 for firmly holding the wings and end rails in assembled position.

Preferably, each of the side rail, end rail, shutter panel and mullion elements hereinabove described is formed of integral molded plastic construction. Side rails 12, 14 may be formed in an extrusion operation and cut to desired basic lengths, such as lengths in multiples of one foot. Shutter panels 20, 22 mullion 24 and end rails 16, 18 may be formed in respective injection molding operations. Shutter panels 20, 22 specifically may be molded and then trimmed in the factory to standard lengths such, as one foot lengths, for packaging purposes. Preferably, the surfaces of all shutter elements which are exposed for viewing in use are suitably embossed so as to simulate a woodgrain appearance. The shutter elements may be formed of polystyrene, and preferably painted or coated both for pigmentation purposes and to filter or screen solar ultraviolet radiation which may cause fading or structural deterioration of the plastic material.

In the field, that is at the installation site, shutter side rails 12, 14 and shutter panels 20, 22 if necessary, may be trimmed as desired so as to provide a shutter assembly of overall length suited to the size of the door or window next to which the shutter is to be mounted. More specifically, side rails 12, 14 are cut to length. Louvered shutter panel 20 may be trimmed using a handsaw or snips by cutting center support rib 42 and side runners 44, 46 to the desired length. Solid shutter panel 22 may be trimmed using a hand or sabersaw by cutting across the width of the shutter panel. Scribe lines 200 may be formed on the back surfaces of all elements at the factory at predetermined separation, such as one inch, to facilitate trimming. Preferably, the fastener receiving openings in side rails 12, 14 and wings 78, 80, 108, 110 are formed at the installation site after the trimming and assembly operation to insure proper alignment.

With the shutter elements so trimmed to length, the shutter may be assembled by sliding the shutter panels and mullion strip (if desired) onto the side rails 12, 14 as previously described. End rails 16, 18 are then fitted onto opposite ends of the side rails by sliding the end rail runners into the side rail tracks and fitting the hollow body of the end rail wings into the open side rail ends. The fastener openings are then formed and fasteners 112 are inserted. In accordance with an important feature of the present invention, the forwardly and laterally projecting lips 90, 92 of wings 78, 80, 108 and 110 overlap the trimmed edges of side rails 12, 14 and thus protect the side edges exposed during the trimming operations from the previously mentioned deletrious effects of solar ultraviolet radiation. The provision of a forward wall 82 on each wing insures a pleasing appearance at each side railend rail junction even if the side rails are not neatly trimmed. Likewise, the lips 62, 64 on mullion 24, and the upwardly projecting lip 101 on lower end rail 18, overlap and thus protect edges of shutter panels 20, 22 which may have been exposed during the trimming operation, and also hide poorly trimmed edges. Mullion lip 64 and panel lip 101 also prevents panel 22 form bowing outwardly in assembly. As previously indicated, the rearward edges of ribs 50 on solid panel 22 are coplanar in assembly with the rearward edges of side rails 12, 14. The ribs 50 will thus about the wall surface on which the shutters are mounted and prevent panel 22 from bowing inwardly.

The aforementioned construction is set forth in U.S. Pat. No. 4,765,110, which is incorporated herein by reference.

Figure 2:
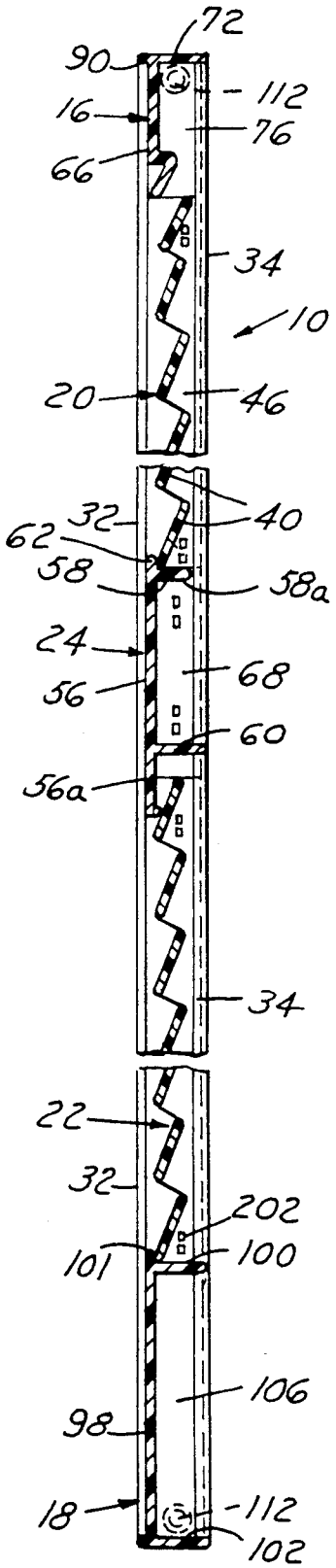
FIG. 2 is a sectional view taken along the line 2—2 in FIG. 1.
Figure 3:
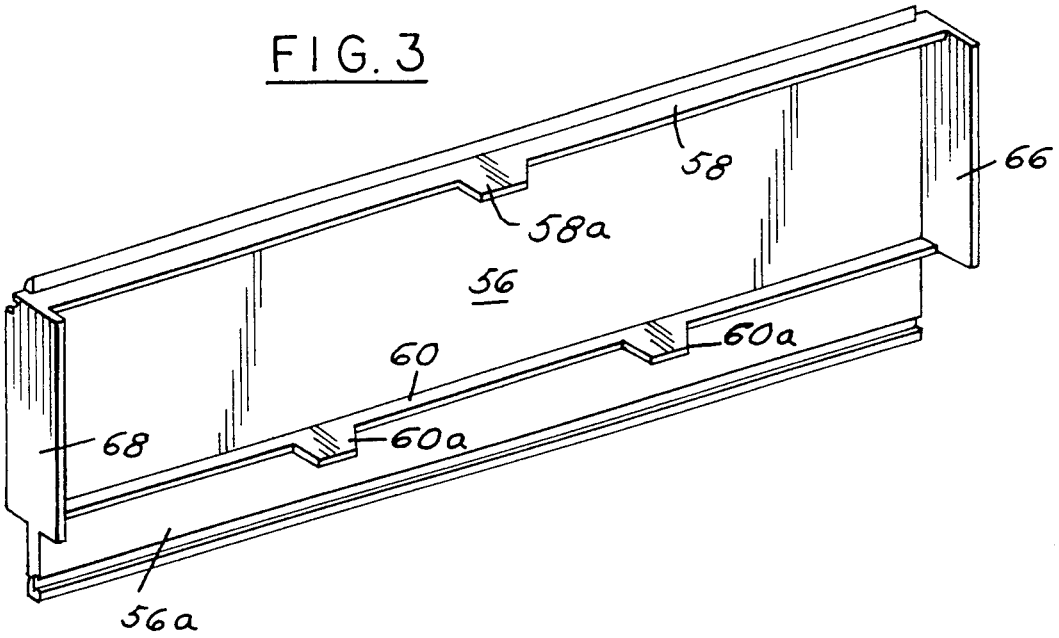
FIG. 3 is a real perspective view of a mullion piece utilized in the product.
Figure 4:
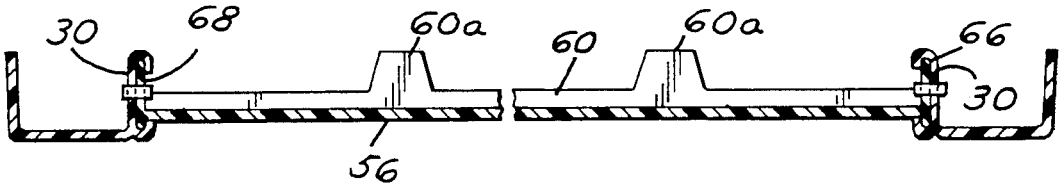
FIG. 4 is a view taken along the line 4—4 in FIG. 1.
Figure 5:
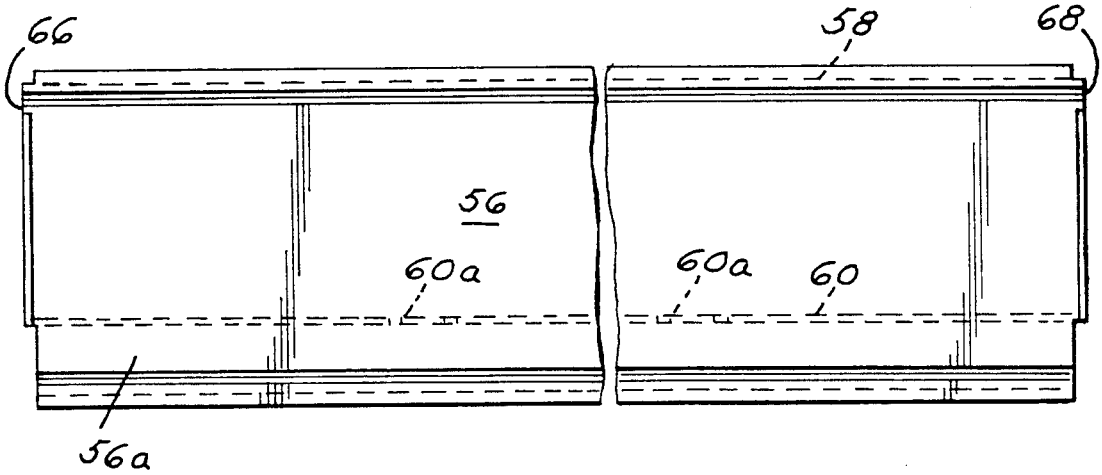
FIG. 5 is a front elevational view of the mullion piece.
Figure 6:
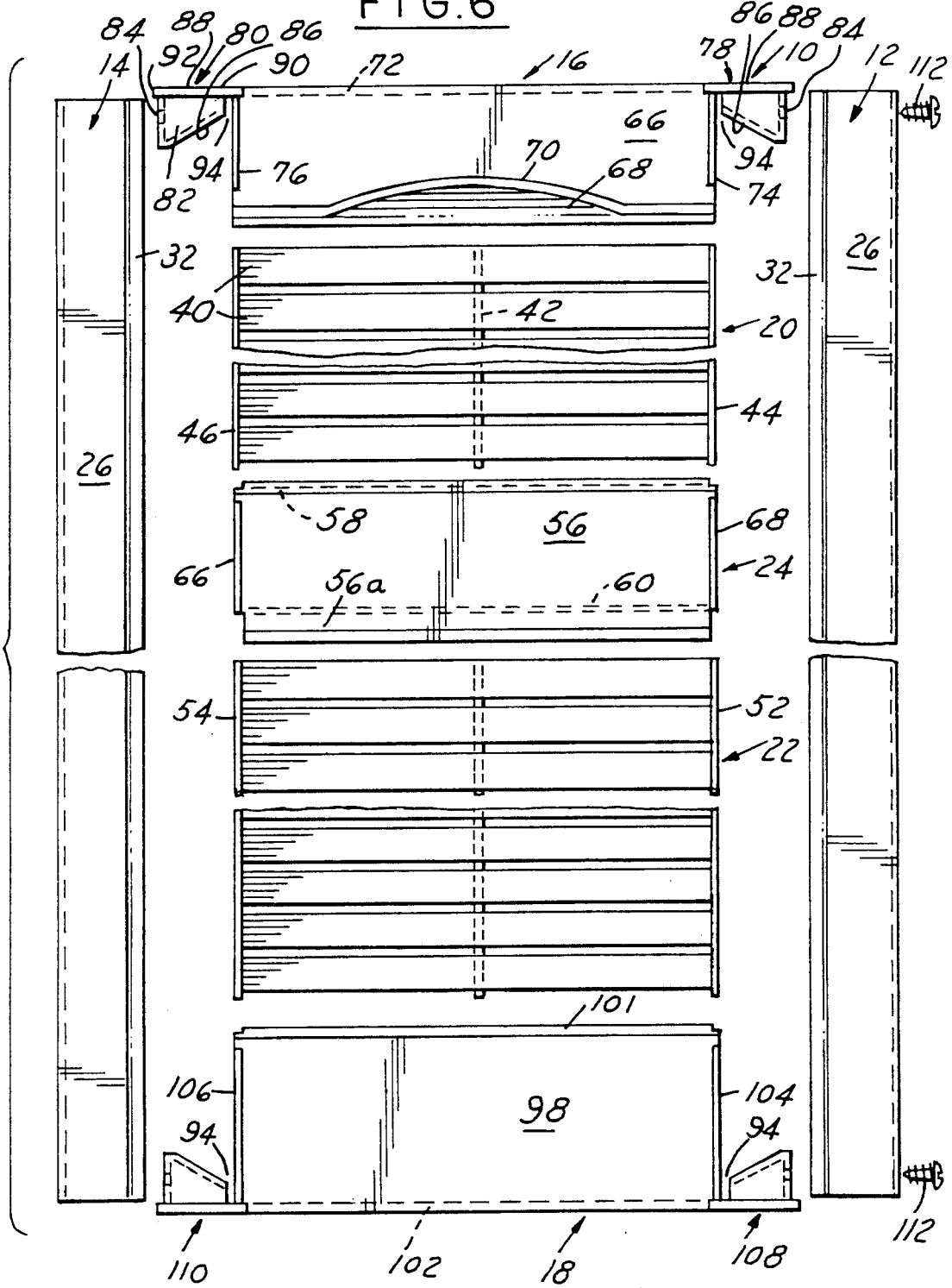
FIG. 6 is an exploded view of the louvered plastic building product.

In accordance with the invention, the mullion piece is formed with a downwardly extending integral lip 56*a* as shown in FIGS. 2, 3, and 5. The lip 56*a* is in the same plane as wall 56 which overlaps the first vane of the lower louver panel 22. In assembly, the lip 56*a* will accommodate variations in the height of the assembled in rails, shutter panels, and mullion member due to expansion so that when fasteners such as staples are provided, the assembly will be a rigid component.

In assembly, the user will first assemble a top end rail 66 or bottom end rail 18, preferably the bottom rail 18 to the side rails 12, 14. The lower louvered panel 22, the mullion 56, the upper louvered panel 20 and the top end rail 16 are successively assembled. If there is a noticeable gap due to dimensional differences the length of the rails, the top and bottom rails and the assembled panels 20, 22 and mullion 56, the mullion 56 can be moved manually in a longitudinal direction to cause the lip 56*a* to cover more or less of the adjacent louver on the panel 22.

The mullion 56 can then be fixed to the rails as by staples. The mullion 56 preferably includes transverse tabs 58*a*, 60*a* which are adapted to engage the side of a building. The runners 66, 68 on the mullion are preferably shorter than the width of the mullion.

Figure 7:
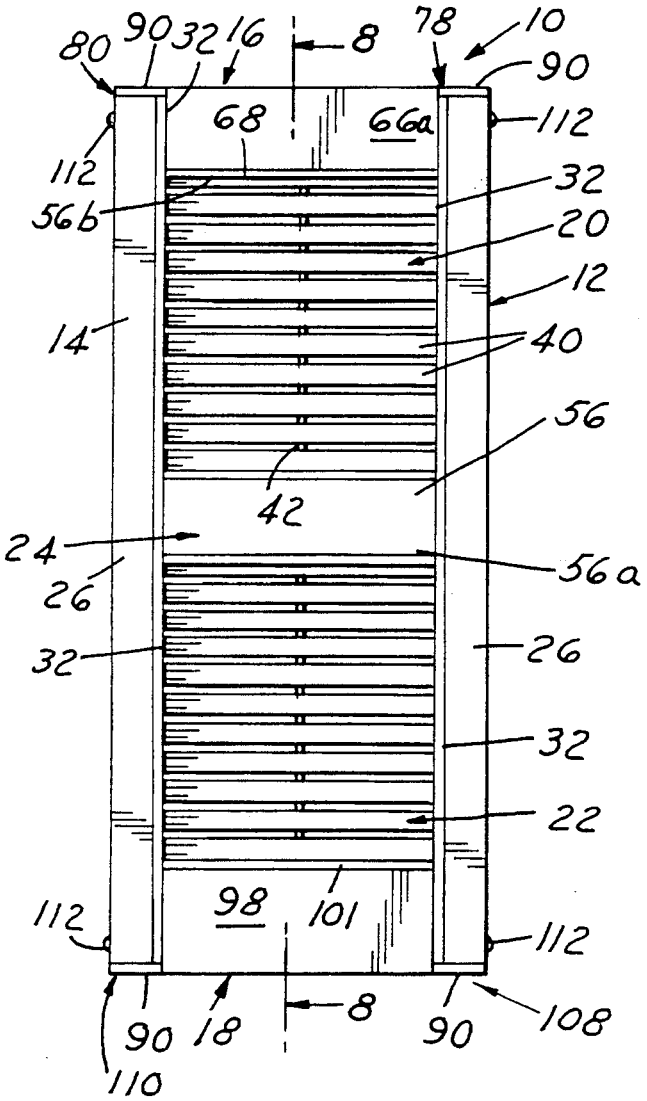
FIG. 7 is an elevational view of a modified louvered building product.
Figure 8:
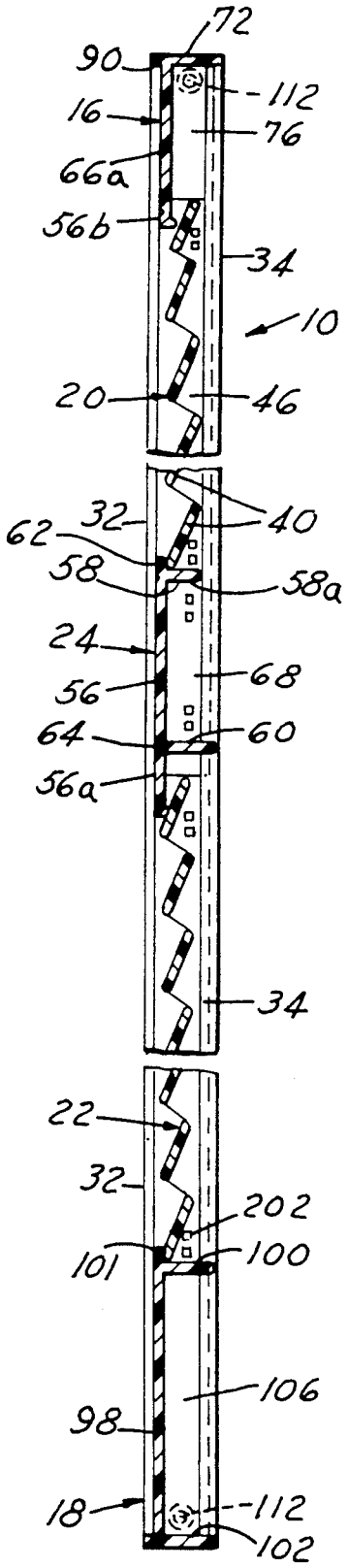
FIG. 8 is a sectional view taken along the line 8—8 in FIG. 7.

In the modified plastic louvered building product shown in FIGS. 7 and 8, a modified top rail 66*a* is provided with a lip 56*b* extending downwardly beyond the runner 76 toward the adjacent louvered panel 20. By providing lip 56*b*, the side rails 12, 14 can be cut to any desired overall length, which may be in increments less than the widths of the louvers. The upper panel 20 can thus be moved into underlying relation to the lip 56*b* to avoid any visible gap. The louvered building product shown in FIGS. 7 and 8 is otherwise the same as that shown in FIGS. 1–6. Alternatively, the lip 56*a* can be eliminated so that the product has only the lip 56*b*.

It can thus be seen that this has been provided a plastic louvered building product such as a shutter of modular construction wherein variations due to shrinkage of the parts longitudinally is accommodated readily by the person assembling the parts; wherein the overall length can be in increments less than the width of a louver; wherein the accommodation is achieved at minimal cost; and wherein the resultant product is aesthetically pleasing.

I claim:

1. A louvered plastic building product comprising a pair of plastic side rail members which may be cut to desired length, each said side rail member including a track extending along the side rail member, a plurality of plastic shutter panels, each said shutter panel having a runner along each side slidably received within said tracks extending along the side rail members, upper and lower plastic end rail members extending between the side rail members, each end rail member having a runner along each side slidably received in said tracks and capturing the panels in assembly, a mullion member, said mullion member having a runner along each side slidably received in said tracks and separating said panels, at least one of said end rail members and said mullion member including a lip, said lip extending beyond the runners on said member having said lip such that said lip overlaps a portion of the louver of the adjacent panel such that when the various parts are assembled, the panels and mullion member can be moved vertically to accommodate dimensional variations between the side rails and the assembled parts with the lip covering any gap that may exist between adjacent members.

2. The louvered plastic building product set forth in claim 1 wherein said mullion member includes a flat wall, said lip being on said mullion member lying in the plane of said wall.

3. The louvered plastic building product set forth in claim 1 wherein said lip is on said upper end rail member.

4. The louvered plastic building product set forth in claim 1 including another lip on the other of said one of said end rail members and said mullion member.

5. The louvered plastic building product set forth in claim 2 wherein said mullion member includes laterally extending tabs adapted to engage the siding on the building.

* * * * *